US005490948A

United States Patent [19]

Klier et al.

[11] Patent Number: 5,490,948

[45] Date of Patent: Feb. 13, 1996

[54] TRANSLUCENT SOLID PRESPOTTING COMPOSITION

[75] Inventors: John Klier, Midland; Gary M. Strandburg, Mount Pleasant; Christopher J. Tucker, Bay City, all of Mich.

[73] Assignee: Dowbrands Inc., Indianapolis, Ind.

[21] Appl. No.: 341,853

[22] Filed: Nov. 18, 1994

Related U.S. Application Data

[63] Continuation of Ser. No. 42,294, Apr. 2, 1993, abandoned.

[51] Int. Cl.[6] ..... C11D 1/04; C11D 17/00

[52] U.S. Cl. ..... 252/122; 252/134; 252/174.24; 252/559; 252/DIG. 16

[58] Field of Search ..... 252/122, 134, 252/174, 174.12, 174.17, 174.18, 174.24, 559, DIG. 16

[56] References Cited

U.S. PATENT DOCUMENTS

| | | | |
|---|---|---|---|
| 3,664,962 | 5/1972 | Kelley et al. | 252/125 |
| 4,289,644 | 9/1981 | Steinhauer et al. | 252/127 |
| 4,396,521 | 8/1983 | Borrello | 252/118 |
| 4,842,762 | 6/1989 | Sabol, Jr. et al. | 252/109 |
| 4,909,962 | 3/1990 | Clark | 252/547 |
| 4,990,269 | 2/1991 | Andreasson et al. | 252/554 |
| 5,158,710 | 10/1992 | VanEenam | 252/539 |

*Primary Examiner*—Ponnathapura Achutamurthy

[57] ABSTRACT

Disclosed is a translucent solid prespotting composition containing a single phase liquid microemulsion at the processing temperature. The single phase microemulsion comprises a gelling agent, one or more surfactants, a solvent or a mixture of solvents which may contain no more than about 2 weight percent water at 25° C. when the organic solvent is saturated with water in absence of surfactants or other additives, and water in amounts greater than about 15 percent by weight and less than about 60 percent by weight of the composition. The microemulsions before solidifying may be oil continuous, water continuous, or bicontinous.

15 Claims, No Drawings

TRANSLUCENT SOLID PRESPOTTING COMPOSITION

CROSS-REFERENCE TO RELATED APPLICATION

This is a continuation of application Ser. No. 08/042,294 filed Apr. 2, 1993, abandoned.

BACKGROUND OF THE INVENTION

This invention relates to a translucent solid prespotting composition for removal of stains and soils from selected areas of fabrics prior to laundering procedure.

Solid detergent spotting compositions in form of stick have been known in the art. Most of the prior art solid detergent compositions contain less than 15 percent by weight of water and may contain organic solvents based compositions. U.S. Pat. No. 4,396,521 describes a transparent pre-wash detergent stick which contains more than 5 percent but less than 35 percent by weight of water and has a specific dissolution speed at specified temperature and specific penetration hardness.

It would be desirable to provide solid prespotting compositions which contain solvents or mixture of solvents which are substantially water insoluble or immiscible, and provide improved cleaning performance towards a wider range of soils than compositions of the prior art.

SUMMARY OF THE INVENTION

It is an object of the present invention to provide a solid prespotting composition which contains substantially water insoluble or immiscible solvent or mixture of solvents, larger amounts of water than the compositions of the prior arty is more economical, and provides improved cleaning efficacy towards a variety of soils from different fabrics.

In one aspect, the present invention relates to a translucent solid prespotting composition containing a single phase liquid microemulsion at the processing temperature of about 50° C. to about 80° C., comprising:

a) a gellant in an amount sufficient to provide the solid composition of desired hardness;

b) water in an amount greater than about 15 percent by weight and less than about 60% by weight based on the total weight of the composition;

c) an organic solvent or a mixture of two or more organic solvents, wherein the organic solvent or mixture of organic solvents may contain no more than about 2 weight percent water at 25° C. when the organic solvent is saturated with water in absence of surfactants or other additives, and wherein the organic solvent or the mixture of two or more organic solvents is in an amount greater than about 9 percent by weight and less than about 60 percent by weight based on the total weight of the microemulsion; and d) one or more surfactants in an amount greater than about 0 percent and less than about 50 percent by weight based on the total weight of the composition; the total amount of a) and d) being greater than about 20 percent by weight and less than about 75 percent by weight;

the liquid microemulsion solidifying into the translucent solid composition on cooling below 50° C.

In another aspect, the present invention relates to a process of preparing the translucent solid composition comprising the steps of:

a) making a single phase microemulsion at the processing temperatures between about 50° C. and about 80° C., and b) cooling the single phase microemulsion to room temperature.

It is an important feature of this invention that the composition before solidifying is a single phase microemulsion at the processing temperatures.

It is another important feature of this invention that the amounts and the type of organic solvent or mixture of solvents, water, one or more surfactants, and gelling agents can be selectively chosen to provide a microemulsion which is a single phase oil continuous, bicontinuous, or water continuous microemulsion at the processing temperatures, which on solidification will be effective in removing stains ranging from oils, greases, ink, milk, blood, tea, grass and the like on cottons, polyester cottons or other synthetic fabrics prior to laundering these fabrics.

The microemulsions of the present invention provide solid prespotting sticks which have requisite physical strength including the property of being soft enough to be transferred to the areas to be treated, and at the same time, maintaining a stable form at the elevated temperatures which are encountered in shipping, and warehousing.

DETAILED DESCRIPTION OF THE INVENTION

Microemulsions for the purpose of this invention are defined as compositions containing two immiscible liquid phases with less than 2.0% miscibility of one into the other in the absence of surfactants. The two immiscible liquids are dispersed one into the other by using a surfactant. The dispersed component or the dispersed phase generally has an average radius less than about 1000 Angstroms but at least about 50 Angstroms so that the microemulsion is perceived as a single phase. Due to the small size of the dispersed phase, the microemulsion formed at the processing temperature is thermodynamically stable. The single phase microemulsions of the present invention do not include solutions.

The essential ingredients of the compositions are: gelling agent, organic solvent or mixture of organic solvent, one or more surfactants, and water.

The gelling agent suitable for obtaining the solid compositions of the present invention include: soaps of fatty acids, long chain alcohols such as stearyl alcohol, and polymeric materials such as methyl cellulose, xanthan gum, salts of carboxymethyl cellulose, and polyacrylic acid and the like. Some nonionic or ionic surfactants known in the art as gelling agents may also be used for the purposes of this invention. The gelling agent is used in amounts sufficient to produce the solid composition of desired hardness. The desired hardness for the purpose of this invention ranges from about 60 to about 120 tenths of a millimeter as measured by using a penetrometer as specified in ASTM D-127. Generally the amount of gelling agent used is greater than about 5 percent by weight and less than about 25 percent by weight based on the total weight of the composition.

The most preferred gelling agent is soap, which is an alkali metal, ammonium, amine, or substituted amine salt of a fatty acid. The soap may be formed in situ by saponification of the fatty acids by any alkali metal-, alkaline earth metal-, ammonium-, or amine-salt forming base, as for example, sodium, potassium, magnesium, or ammonium hydroxides, mono-di- or triethanol-, or -propanol-amines, or any other such base providing a salt of the fatty acid being saponified. The base is added to saponify the fatty acid and to obtain the solid composition of desired hardness.

The amount of soap used depends upon the type of fatty acid, the amount of solvent, the hydrophobicity of the solvent, the amount of watery and the type of surfactant, and the degree of hardness. Suitable fatty acid include saturated and unsaturated acids, for example, stearic acid, palmitic acid, oleic acid, lauric acid, linoleic acid, and the like and mixtures thereof. The preferred fatty acid is stearic acid. Examples of commercially available stearic acid include: INDUSTRENE 5016, available from Witco Corporation, or Hydrofoil Acid 1870 available from Sherex Chemical Company.

Generally the amount of soap used is in amounts greater than about 5 percent by weight and less than about 25 percent by weight based on the total weight of the composition.

In the single phase continuous microemulsions, an organic solvent or a mixture of two or more organic solvents is employed, wherein the organic solvent or mixture of organic solvents is characterized as containing no more than about 2 weight percent water at 25° C. when the organic solvent is saturated with water in the absence of surfactants or other additives. Preferably, the organic solvent or mixture of organic solvents contain no more than about 1 weight percent water at 25° C. when saturated, more preferably no more than about 0.5 weight percent water. This can be readily determined by water titration, for example, wherein water is added to the one or more organic solvents until cloudiness of solution is observed or an excess water phase develops.

The organic solvent or the mixture of two or more organic solvents is present in an amount greater than about 9 percent and less than about 60 percent by weight based on the total weight of the microemulsion. Preferably, the organic solvent or the mixture of two or more organic solvents is present in an amount greater than about 12 weight percent, more preferably greater than about 15 percent; preferably less than about 40 weight percent, and more preferably less than about 30 weight percent based on the weight of the composition.

Classes of organic solvents that can be used in the practice of this invention include aliphatic alcohols, dialiphatic esters, aliphatic hydrocarbons, chlorinated aliphatic hydrocarbons, aromatic hydrocarbons, aliphatic diesters, aliphatic ketones, and aliphatic ethers. In addition, a solvent can contain two or more of these functional groups or can contain combinations of these functional groups. For example, alkylene glycol monoethers, dialkylene glycol diethers, and alkylene glycol ether acetates may be employed as solvents in the practice of this invention. The alkylene glycol monoethers and dialkylene glycol diethers are particularly useful to decrease viscosity of a microemulsion. Preferred classes of organic solvents are the aliphatic hydrocarbons, aromatic hydrocarbons, alkylene glycol monoethers, dialkylene glycol diethers, and alkylene glycol ether acetates. More preferred classes of organic solvents are the aliphatic hydrocarbons, aromatic hydrocarbons, alkylene glycol monoethers, and dialkylene glycol diethers.

The aliphatic alcohols can be primary, secondary or tertiary. Preferred aliphatic alcohols have 4 to 40 carbon atoms. Representative examples of more preferred aliphatic alcohols include octanol, 2-ethyl-hexanol, nonanol, dodecanol, undecanol, and decanol.

Preferred dialiphatic esters have 4 to 24 carbon atoms. Representative examples of more preferred dialiphatic esters include methyl laurate, methyl oleate, hexyl acetates, pentyl acetates, octyl acetates, nonyl acetates, and decyl acetates.

The aliphatic hydrocarbons can be linear, branched, cyclic or can combinations thereof. Preferred aliphatic hydrocarbons contain 3 to 40 carbon atoms, preferably 6 to 24 carbon atoms. Representative examples of more preferred aliphatic hydrocarbons include alkanes such as liquid propane, butane, hexane, octane, decane, dodecane, hexadecane, mineral oils, paraffin oils, decahydronaphthalene, bicyclohexane, cyclohexane, olefins such as 1-decene, 1-dodecene, octadecene, and hexadecene, and terpenes such as limonene and pinene. Example of commercially available mineral oil is Witco #40 which is a white mineral oil commercially available from Witco Corporation. Examples of commercially available aliphatic hydrocarbons are Norpar 12, 13, and 15 (normal paraffin solvents available from Exxon), Isopar G, H, K, L, M, and V (isoparaffin solvents available from Exxon), and Shellsol solvents (Shell).

Preferred chlorinated aliphatic hydrocarbons contain 1 to 12 carbon atoms, more preferably contain from 2 to 6 carbon atoms. Representative examples of more preferred chlorinated aliphatic hydrocarbons include methylene chloride, carbon tetrachloride, chloroform, 1,1,1-trichloroethane, perchloroethane, and trichloro ethylene.

Preferred aromatic hydrocarbons contain 6 to 24 carbon atoms. Representative examples of more preferred aromatic hydrocarbons include toluene, napthalene, biphenyl, ethyl benzene, xylene, alkyl benzenes such as dodecyl benzene, octyl benzene, and nonyl benzene. An example of alkylbenzene solvent is Nalkylene 500 Detergent Alkylate commercially available from Vista Chemical.

Preferred aliphatic diesters contain 6 to 24 carbon atoms. Representative examples of more preferred aliphatic diesters include dimethyl adipate, dimethyl succinate, dimethyl glutarate, diisobutyl adipate, and diisobutyl maleate.

Preferred aliphatic ketones have 4 to 24 carbon atoms. Representative examples of more preferred aliphatic ketones include methyl ethyl ketone, diethyl ketone, diisobutyl ketone, methyl isobutyl ketone, and methyl hexyl ketone.

Preferred aliphatic ethers have 4 to 24 carbon atoms. Representative examples of more preferred aliphatic ethers include diethyl ether, ethyl propyl ether, hexyl ether, butyl ether, and methyl t-butyl ether.

Preferred alkylene glycol monoethers, dialkylene glycol diethers, and alkylene glycol ether acetates include propylene glycol diethers having 5 to 25 carbon atoms, propylene glycol ether acetates having 6 to 25 carbon atoms, propylene glycol monoethers having 7 to 25 carbon atoms, ethylene glycol ether acetates having 6 to 25 carbon atoms, ethylene glycol diethers having 6 to 25 carbon atoms, and ethylene glycol monoethers having 8 to 25 carbon atoms. Representative examples of more preferred solvents within this broad class include propylene glycol dimethyl ether, propylene glycol benzyl methyl ether, propylene glycol butyl methyl ether, propylene glycol dibutyl ether, dipropylene glycol dimethyl ether, dipropylene glycol butyl methyl ether, dipropylene glycol dibutyl ether; propylene glycol methyl ether acetate, dipropylene glycol methyl ether acetate, propylene glycol butyl ether acetate; propylene glycol monobutyl ether, propylene glycol monohexyl ether, dipropylene glycol monobutyl ether, dipropylene glycol monohexyl ether; ethylene glycol ethyl ether acetate, ethylene glycol butyl ether acetate, diethylene glycol butyl ether acetate; ethylene glycol diethyl ether, ethylene glycol dibutyl ether; ethylene glycol hexyl ether, ethylene glycol octyl ether, ethylene glycol phenyl ether, diethylene glycol hexyl ether, and diethylene glycol octyl ether.

The water employed for the purpose of this invention is in the amounts greater than about 15% by weight and less than about 60% by weight, more preferably greater than about 15 percent by weight and less than about 50% by weight, and most preferably in an amount greater than 18% by weight and less than about 40% by weight of the composition. The above stated amount of water includes water introduced from other ingredients added to the composition and reaction products thereof. Preferably, the water used is deionized water.

The surfactants employed for the purpose of this invention may be selected from anionic, nonionic, cationic, amphoteric, and polymeric surfactants known in the art. The surfactant may be a single surfactant or a mixture of surfactant. The surfactants may be water soluble or water insoluble. The amount of one or more surfactants employed is in an amount greater than about 0 percent by weight and less than about 50 percent by weight based on the total weight of the single phase microemulsion.

Useful anionic surfactants include salts of alkyl benzene sulfonates including petroleum sulfonates, alkyl sulfates, alkyl polyethoxy ether sulfates, paraffin sulfonates, alpha-olefin sulfonates, alpha-sulfocarboxylates and esters thereof, alkyl glycerol ether sulfonates, fatty acid monoglyceride sulfates and sulfonates, alkyl phenol polyethoxy ether sulfates, 2-acyloxy-alkane-1-sulfonate, fatty acid salts, sulfated oils such as sulfated castor oil, and beta-alkyloxy alkane sulfonate. Preferred anionic surfactants include, for example, linear alkylbenzene sulfonates.

Useful cationic surfactants include quartenary ammonium surfactants; primary, secondary, and tertiary ammonium salts; amine oxides, alkyl pyridinium surfactants; alkyl piperidinium surfactants; and imidazolinium surfactants.

Nonionic surfactants employed in this invention include primary alcohol, secondary alcohol, and alkylphenol alkoxylates wherein the alkoxylate can be ethoxy, propoxy, butoxy or combinations thereof. Mixtures of alcohol alkoxylates can be used. Preferred nonionic surfactants are primary, secondary alcohol, and alkyl phenol ethoxylates. Commercially available nonionic surfactants are sold by Shell Chemical Company under the tradename Neodol and by Union Carbide Corporation under the tradename Tergitol. Representative examples of preferred commercially available nonionic surfactants include Tergitol 15-s-series and NP series, and Neodol 91, 23, or 25 series. Additional representative examples of useful nonionic surfactants include polyoxyethylated polypropylene glycols, polyoxyethylated polybutylene glycols, polyoxyethylated mercaptans, glycerol and polyglyceryl esters of natural fatty acids, polyoxyethylenated sorbitol esters, polyoxyethylenated fatty acids, alkano amides, tertiary acetylinic glycols, N-alkylpyrrolidones, and alkyl polyglycosides.

Preferred nonionic surfactants include ethoxylated linear alcohols, ethoxylated branched secondary alcohols, and ethoxylated alkylphenols. Representative examples of preferred commercially available secondary alcohol ethoxylates include: Tergitol 15-s-3, Tergitol 15-s-5 and Tergitol 15-s-7, those of primary alcohol ethoxylates include: Neodol 23- 3, and Neodol 23-7, and those of ethoxylated alkylphenols include NP-6.

The microemulsions of this invention may further contain other types of surfactants such as amphoteric surfactants, betaines, and sultaines.

The compositions of the present invention may optionally contain more than 0% to less than about 10% of dyes, brighteners, preservatives, disinfectants, stabilizers, UV absorbers, perfumes, soil suspending agents, detergent builders, electrolytes, fungicides, and chelating agents known in the art. The compositions may further contain enzymes. The enzymes used include protease, lipase, amylase, or mixtures thereof, in the form of a stabilized blend or unstabilized preparations with calcium salts added for stabilization.

The type of microemulsion structure obtained at the processing temperature is dependent upon the surfactant hydrophilicity, the solvent type or solvent mixture chemistry, the amount of water and other components present in the composition. A generalized process to design the desired microemulsion structure is outlined below. In the process, the hydrophilicites of the surfactants or surfactant blends are systematically varied to progress through a transition from water continuous to oil continuous microemulsion. It is understood that any component or parameter (i.e. water level, solvent mixture, electrolyte, temperature, etc.) that can cause this transition to occur may also be varied to obtain a microemulsion which is a single phase, oil continuous microemulsion, or a single phase bicontinous or single phase water continuous microemulsion at the processing temperatures ranging from about 50° C. to about 80° C.

The first step is to select a suitable solvent or a mixture of solvent from the classes of solvents as previously described. In the second step, a composition containing selected amounts of water, above selected solvent or mixture of solvents, surfactants, gelling agent, and other ingredients is prepared. The next step is to establish the relationship, at the processing temperature, between the surfactant hydrophilicity and microemulsion structure of composition prepared in the second step. This is accomplished by systematically varying surfactant mixture hydrophilicity, and correlating surfactant hydrophilicity with microemulsion structure, and physical properties.

The microemulsion compositions may be oil continuous, water continuous or bicontinous. If an optimum single phase microemulsion is not obtained following the above described steps, the amounts and ratios of individual ingredients may be adjusted. These adjustments may involve varying surfactant level, the amounts of solvent or mixture of solvents, water, gelling agents, and other additives and repeating the surfactant selection process as described above until the optimum single phase microemulsion results.

An optimum single phase microemulsion as used herein means a microemulsion of the desired type which is fluid at the processing temperature and of desired hardness on cooling below the processing temperature. Hardness is described at page 16.

Fluid as used herein means a liquid having a viscosity less than 100 centistokes as measured at the processing temperature by capillary viscometer such as a Cannon-Fenske equipped with a size 350 capillary following the procedure of ASTM D 445.

One way to determine the type of single phase microemulsion obtained at the processing temperature is to dilute the microemulsion with a mixture of oil and water in the proportion present in the microemulsion before dilution. An oil continuous microemulsion will form Winsor Type II (oil continuous microemulsion in equilibrium with water) system upon dilution, a water continuous microemulsion will form Winsor Type I (water continuous in equilibrium with excess oil) system, whereas a bicontinous microemulsion will form a Winsor Type III system (a microemulsion in equilibrium with both excess oil and water).

The type of microemulsion desired is determined by the types of soils that are desired to be removed from the fabric.

An oil continuous microemulsion may be particularly suitable for removing oil and grease based stains, while the water continuous may be suitable for water based stains. It is critical for the purposes of this invention that the microemulsion be a single phase at the processing temperature before it is cooled below 50° C. to the translucent solid composition of the desired shape.

Once the types and the amounts of various ingredients are predetermined for obtaining an optimum single phase microemulsion at the processing temperature, the solid composition of the invention is generally prepared as follows:

The predetermined amounts of the organic solvent or mixture of solvents, one or more surfactants are combined and heated to a selected temperature between 50° C. and about 80° C. After the surfactants have dissolved in the solvent, a predetermined amount of deionized water is added and the mixture allowed to reach thermal equilibrium. A predetermined amount of gelling agent, which is preferably a salt of a fatty acid or a mixture of fatty acids is added slowly to maintain the temperature of the mixture. Soap may also be prepared in situ by saponification of the fatty acid or mixture of fatty acid by a base as described hereinabove. After the soap or the gelling agent has completely dissolved and a single phase microemulsion obtained, the mixture is poured into the dispensers, or removable molds of desired shape and allowed to cool to room temperature.

Before the entire microemulsion is allowed to cool, it is desirable to solidify a sample of the microemulsion to determine the hardness of the composition.

The hardness of the composition is measured in accordance with ASTM Standard D-127. The procedure involves using a penetrometer equipped with a standard cone weighting 150 grams without any weight added. Stick hardness is reflected by the depth the cone penetrates into the solidified composition in a period of five seconds. The depth is reported in tenths of a millimeter. Higher the number, softer is the composition. The hardness for the composition of this invention preferably ranges from about 60 to about 120 tenths of a millimeter. If the hardness of the composition is outside this range, the composition may either be made softer by using additional amounts of solvent, surfactant or water, or harder by adjusting the amounts of soap added.

One advantage the making the solid composition from the single phase microemulsion is that the reaction can be carried out in one mixing vessel with minimal concern over the order in which various ingredients are added. The agitation, after the microemulsion is obtained, can be interrupted without any detrimental effect to the the structure of the composition.

A preferred form of the composition is the stick form. The method of using the composition involves first rubbing the soiled fabric with the stick, and then laundering the pretreated fabric by a known procedure. The stick with hardness from about 60 to about 120 tenths of a millimeter will transfer greater than about 0.1 grams and less than about 0.5 grams of the composition on to a polyester/cotton (65:35) fabric, when rubbed under a 2.0 kg weight for a distance of about 10 cms.

The efficacy of the pre-spotting solid compositions of the invention towards used automotive oil is determined by measuring CIE Tristimulus values using HUNTER D-25 OPTICAL SENSOR. White polyester/cotton (65/35) and cotton fabric swatches (5 inches square) are placed on a horizontal surface. Three drops of used motor oil are placed on the white polyester/cotton fabric and four drops of the same are placed on white cotton fabric. The oil is allowed to wick overnight to give uniformed soiled fabric. The soiled fabrics are treated with the solid compositions of the present invention and allowed to stand for five minutes. The swatches are then laundered in a Terg-otometer (U.S. Testing Laboratories) mini washing machine at 100 rpm using tap water at about 100° F. charged with 2.0 grams of standard 850 laundry detergent, which is an aqueous mixture of anionic and nonionic surfactants devoid of any enzymes or complexing agent. At the end of the wash cycle, the swatches are rinsed for five minutes in cold tap water. The swatches are then evaluated using optical reflectance to measure CIE Tristimulus values.

The "percent clean" of the fabric after treatment with the compositions of the invention is calculated using the following equation:

$$\%\ \text{Clean} = \frac{((X_W - X_D)^2 + (Y_W - Y_D)^2 + (Z_W - Z_D)^2)^{1/2}}{((X_C - X_D)^2 + (Y_C - Y_D)^2 + (Z_C - Z_D)^2)^{1/2}}$$

where X,Y, and Z are CIE Tristimulus Values and the subscripts W, C, and D denote washed fabric, clean fabric, and dirty fabric, respectively. CIE Tristimulus values and the method of measurement are described in "Measurement of Appearance", R. S. Hunter, et. al; John Wiley & Sons; 2nd. Ed. 1987.

The following examples are included for the purposes of illustration only and are not to be construed to limit the scope of the invention or claims. Unless otherwise indicated, all parts and percentages are by weight.

The requisite amounts and types of the ingredients for the compositions of the following examples are predetermined by the process described hereinabove on pages 13–14. The solid compositions are then generally prepared from the predetermined amounts of the various ingredients in the manner described under Example 1.

EXAMPLE 1

This example illustrates a translucent solid composition obtained from an oil continuous microemulsion as determined by the process described at page 14.

| Component | Wt. % |
|---|---|
| Witco #40 oil | 10.0 |
| Neodol 23-3 | 28.0 |
| Tergitol 15-S-3 | 12.0 |
| Tergitol NP-6 | 13.0 |
| Sodium Dodecylbenzene Sulfonate | 5.0 |
| Sodium Stearate | 12.0 |
| Deionized Water | 20.0 |
| Hardness of the stick | 110 tenths of a millimeter |

Witco #40 is a white mineral oil, commercially available from Witco Corporation, Neodol 23-3 is a nonionic surfactant, commercially available from Shell Chemical Company, Tergitol 15-S-3, and Tergitol NP-6 are nonionic surfactants commercially available from Union Carbide Corporation.

Witco #40 and the nonionic surfactants are mixed together and heated to a temperature between about 50° to about 80° C. and sodium dodecylbenzene sulfonate added. After sodium dodecylbenzene sulfonate has dissolved completely, deionized water is added and the mixture is allowed to reach thermal equilibrium. Sodium stearate is added slowly while maintaining about the processing temperature. After sodium stearate has completely dissolved, the mixture is poured into the cylindrical canisters or dispensers and allowed to cool to room temperature. Translucent cylindrical solid sticks are thus obtained.

EXAMPLE 2

This example illustrates a composition containing an enzyme mixture to assist in the removal of proteinaceous type of soils. The composition is oil continuous as determined by the process described at page 14.

| Component | Wt. % |
|---|---|
| Witco #40 Oil | 9.0 |
| Nalkylene 500 Detergent Alkylate* | 11.0 |
| Neodol 23-3 | 22.0 |
| Tergitol 15-S-3 | 10.0 |
| Tergitol NP-6 | 11.0 |
| Sodium Dodecylbenzene Sulfonate | 5.0 |
| Deionized Water | 20.0 |
| Sodium Stearate | 10.0 |
| Protease/Amylase Enzyme Mixture | 2.0 |
| Hardness | 95 tenths of a millimeter |

*Nalkylene 500 Detergent Alkylate is linear alkylbenzene, commercially available from Vista Chemical

EXAMPLE 3

This example illustrates a composition which is obtained from a single phase microemulsion which is not oil continuous as determined by the process described at page 14.

| Component | Wt. % |
|---|---|
| Witco #40 Oil | 9.0 |
| Nalkylene 500 Detergent Alkylate* | 11.0 |
| Neodol 23-7 | 22.0 |
| Tergitol 15-S-7 | 10.0 |
| Tergitol NP-6 | 12.0 |
| Sodium Dodecylbenzene Sulfonate | 5.0 |
| Deionized Water | 20.0 |
| Sodium Stearate | 10.0 |
| Hardness | 95 tenths of a millimeter |

*Nalkylene 500 Detergent Alkylate is linear alkylbenzene, commercially available from Vista Chemical

EXAMPLE 4

This example illustrates a composition wherein the soap component is prepared in situ. The aqueous sodium hydroxide (50%) used here introduces additional water into the composition.

| Component | Wt. % |
|---|---|
| Witco #40 Oil | 8.9 |
| Nalkylene 500 Detergent Alkylate* | 10.3 |
| Neodol 23-3 | 20.7 |
| Tergitol 15-S-3 | 9.4 |
| Tergitol NP-6 | 11.3 |
| Sodium Hydroxide (50%) | 4.4 |
| Deionized Water | 17.0 |
| Dodecylbenzene Sulfonic Acid | 4.7 |
| Stearic Acid** | 11.3 |
| Protease/Amylase Enzyme Mixture | 2.0 |
| Hardness | 100 tenths of a millimeter |

-continued

| Component | Wt. % |
|---|---|

*Nalkylene 500 Detergent Alkylate is linear alkylbenzene, commercially available from Vista Chemical
**Commercial stearic acid

EXAMPLES 5–8

These examples illustrate compositions obtained from oil continuous single phase microemulsions as determined by the process described at page 14, containing about 35% percent by weight of water.

| | Parts | | | |
|---|---|---|---|---|
| Component | 5 | 6 | 7 | 8 |
| Witco #40 Oil | 9.0 | — | — | — |
| Norpar 15 | — | 20.0 | 20.0 | 20.0 |
| Nalkylene 500 Detergent Alkylate* | 10.0 | — | — | — |
| Neodol 23-3 | 5.0 | 8.0 | — | — |
| Tergitol 15-S-3 | 10.0 | 12.0 | 20.0 | 20.0 |
| Tergitol NP-6 | 5.0 | — | — | — |
| Dodecylbenzene Sulfonic Acid | 5.0 | 5.0 | 5.0 | 5.0 |
| Sodium Hydroxide (50%) | 5.6 | 5.6 | 5.6 | 5.6 |
| Deionized Water | 35.0 | 35.0 | — | 35.0 |
| 10% Aqueous NaCl Solution | — | — | 35.0 | — |
| Stearic Acid** | 15.0 | 15.0 | 15.0 | 15.0 |

*Nalkylene 500 Detergent Alkylate is linear alkylbenzene, commercially available from Vista Chemical
**commercial stearic acid

EXAMPLE 9

The efficacies of the compositions of Examples 2 and 3, and of the commercially available sticks towards the used motor oil removal from polyester/cotton and cotton fabrics are compared in the manner described hereinabove at pages 16–17. Table I illustrates the results obtained.

TABLE I

| Sample | Used Motor Oil Removal % Clean Polyester/Cotton |
|---|---|
| Stain Stick* | 33 |
| Shout Stick** | 39 |
| Example 2 | 54 |
| Example 3 | 60*** |
| | **Used Motor Oil Removal % Clean Cotton** |
| Stain Stick* | 41 |
| Shout Stick** | 53 |
| Example 2 | 78 |
| Example 3 | 63*** |

*Trademark of DowBrands L.P.
**Trademark of S.C. Johnson and Son
***Average value of two tests As can be seen from Table I, the compositions of the invention are more efficacious towards used oil removal than the commercial products.

The efficacies of the compositions of Examples 3 and 4, and of the prior art towards the used motor oil removal from polyester/cotton and cotton fabrics are compared in the manner described hereinabove at pages 16–17. Table II illustrates the results obtained.

TABLE II

| Component | Weight Percent | | | |
|---|---|---|---|---|
| | Example (a) Prior art | Example (b) Prior art | Example (3) | Example (4) |
| Soap | Hydrogenated Tallow 12.5 | Commercial stearic acid 8.0 | Sodium Stearate 10.0 | Commercial Stearic acid 11.3 |
| Surfactant | Nonionic $C_{14-15}$ alkanols + 11EO 28.0 | Nonionic Primary $C_{14-15}$ alcohols + 11EO 20.0 Secondary alcohol + 7EO 20.0 | Nonionic Neodol 23-7 22.0 Tergitol 15-5-7 10.0 Tergitol NP-6 12.0 Anionic Sodium benzene Sulfonate 5.0 | Nonionic Neodol 23-3 20.7 Tergitol 15-5-3 9.4 Tergitol NP-6 11.3 Anionic Sodium benzene Sulfonic acid 4.7 |
| Solvent | Benzyl alcohol 20.0 Propylene glycol 30.0 | Benzyl alcohol 20.0 Propylene glycol 20.0 | Witco #40 oil 9.0 Nalkylene 500 Detergent Alkylate 11.0 | Witco #40 oil 8.9 Nalkylene 500 Detergent Alkylate 10.3 |
| Water | Deionized 5.0 | Deionized 2.0 | Deionized 20.0 | Deionized 17.0 |
| Sodium Hydroxide | (38% aqueous) 4.1 | (49% aqueous) 2.7 | — | (50% aqueous) 4.4 |
| Optional Ingredients | Dye 0.4 | — | — | Protease/ amylase Enzyme Mixture 2.0 |
| % Clean used Motor Oil Polyester/ cotton | 40 | 35 | 60* | 65 |
| % Clean used Motor Oil cotton | 26 | 25 | 63* | 86 |

*Average value of two tests

As can be seen from Table II, the compositions of the present invention contianing larger amounts of water than those of the prior art exhibit significantly superior cleaning performance towards oily soils.

What is claimed is:

1. A translucent solid prespotting composition obtained by first forming a single phase microemulsion which is a liquid at the processing temperature between about 50° C. and about 80° C., said liquid microemulsion comprising:

a) a gellant in an amount sufficient to provide the solid composition a hardness of from about 60 to about 120 tenths of a millimeter (ASTM D-127);

b) water in an amount greater than about 15 percent by weight and less than about 60 percent by weight based on the total weight of the composition;

c) an organic solvent or a mixture of two or more organic solvents in an amount greater than about 9 percent by weight and less than about 60 percent by weight based on the total weight of the microemulsion; and d) one or more surfactants in an amount greater than about 0 percent and less than about 50 percent by weight based on the total weight of the composition; the total amount of a) and d) being greater than about 20 percent by weight and less than about 75 percent by weight;

wherein the solvent or mixture of solvents in said composition consists only of a water immiscible organic solvent or solvents or a mixture of organic solvents containing no more than about 2 weight percent water at 25° C. when the organic solvent or mixture of organic solvents is saturated with water in absence of surfactants and other additives and cooling, the liquid microemulsion to below 50° C. to form the translucent solid composition.

2. The translucent solid composition of claim 1, wherein the gelling agent is soap.

3. The translucent solid composition of claim 2, wherein the amount of soap used is greater than about 5 percent by weight and less than about 25 percent by weight based on the total weight of the composition.

4. The translucent solid composition of claim 2, wherein the soap is a sodium salt of stearic acid.

5. The translucent solid composition of claim 1, wherein the water is in an amount greater than about percent by weight and less than about 50 percent by weight of the microemulsion.

6. The translucent solid composition of claim 1, wherein the water is present in an amount greater than about 18 percent and less than about 40 percent by weight of the microemulsion.

7. The translucent solid composition of claim 1, wherein the organic solvent or the mixture of two or more organic solvents is present in an amount greater than about 12 weight percent and less than about 40 percent by weight of the microemulsion.

8. The translucent solid composition of claim 1, wherein the organic solvent or the mixture of two or more organic solvent is present in an amount greater than about 15 percent and less than about 30 weight percent based on the weight of the microemulsion.

9. The translucent solid composition of claim 1, wherein the organic solvent is mineral oil, alkylbenzene, paraffinic hydrocarbons containing 10 to 40 carbon atoms or mixtures thereof.

10. The translucent solid composition of claim 1, wherein said surfactant is a salt of alkylbenzene sulfonate.

11. The translucent solid composition of claim 1, wherein one or more surfactant is a primary alcohol ethoxylate, a secondary alcohol ethoxylate, ethoxlyated alkyl phenol, or a mixture thereof.

12. A process of preparing a translucent solid composition comprising the steps of first preparing a single phase microemulsion which is a liquid at the processing temperature between about 50° C. and about 80° C., and solidifying the microemulsion by cooling below about 50° C. wherein the preparation of the single phase microemulsion comprises the steps of mixing from greater than about 9 percent by weight and less than about 60 percent by weight based on the total weight of the microemulsion of a solvent which consists only of a water immiscible organic solvent or a mixture of water immiscible organic solvents with from greater than about 0 percent and less than about 50 percent by weight of one or more surfactants and heating the mixture to the processing temperature, adding greater than about 15 percent by weight and less than about 60 percent buy weight based on the total weight of the composition of deionized water, slowly adding an amount of a soap sufficient to provide the solid composition a hardness of from about 60 to about 120 tenths of a millimeter (ASTM D-127) to maintain the temperature of the mixture and allowing the single phase microemulsion so obtained to cool to room temperature.

13. The process of claim 12, wherein the preparation of the single phase microemulsion comprises the steps of mixing predetermined amounts of an organic solvent or a mixture of organic solvents with predetermined amounts of one or more surfactants and heating the mixture of the processing temperature, adding predetermined amounts of deionized water, slowly adding predetermined amounts of a soap to maintain the temperature of the mixture and allowing the single phase microemulsion so obtained to cool to room temperature.

14. The process of claim 13, where the water immiscible organic solvent or a mixture of water immiscible organic solvents contains no more than about 2 weight percent water at 25° C. when the organic solvent or mixture of organic solvent is saturated with water in absence of surfactants or other additives, and wherein the organic solvent or the mixture of two or more organic solvents is in an amount greater than about 10 percent by weight and less than about 50 percent by weight based on the total weight of the microemulsion.

15. The process of claim 13 wherein the processing temperature ranges between about 55° C. and about 70° C.

* * * * *

UNITED STATES PATENT AND TRADEMARK OFFICE

CERTIFICATE OF CORRECTION

PATENT NO. : 5,490,948

DATED : 13 February 1996

INVENTOR(S) : John KLIER; Gary M. STRANDBURG; and Christopher J. TUCKER

It is certified that error appears in the above-identified patent and that said Letters Patent is hereby corrected as shown below:

column 11, after line 67, insert --solvents or a mixture of organic solvents containing no more than about 2 weight percent water at 25°C when the organic--.

column 12, line 54, insert --15-- after "about".

column 13, line 11, change "one or more" to --said--.

column 13, line 28, change "buy" to --by--.

Signed and Sealed this

Sixteenth Day of February, 1999

*Attest:*

*Attesting Officer*

*Acting Commissioner of Patents and Trademarks*